US006522233B1

(12) United States Patent
Kyoso et al.

(10) Patent No.: US 6,522,233 B1
(45) Date of Patent: Feb. 18, 2003

(54) COIL APPARATUS

(75) Inventors: Yasuo Kyoso, Sakura (JP); Akihiro Hashimoto, Matsudo (JP); Torao Misono, Sanbu-gun (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/971,597

(22) Filed: Oct. 9, 2001

(51) Int. Cl.[7] ..... H01F 5/00
(52) U.S. Cl. ..... 336/200; 336/83; 336/192
(58) Field of Search ..... 336/65, 83, 90, 336/192, 198, 200, 223, 208, 232, 206

(56) References Cited

U.S. PATENT DOCUMENTS 5,175,525 A * 12/1992 Smith ..... 336/83
5,359,313 A * 10/1994 Watanabe et al. ..... 336/83
5,684,445 A * 11/1997 Kobayashi et al. ..... 336/83

FOREIGN PATENT DOCUMENTS

JP 5-335158 12/1993
JP 8-97054 4/1996

* cited by examiner

*Primary Examiner*—Lincoln Donovan
*Assistant Examiner*—Tuyen T. Nguyen
(74) *Attorney, Agent, or Firm*—Oblon, Spivak, McClelland, Maier & Neustadt, P.C.

(57) ABSTRACT

A coil apparatus capable of insulating a one-turn coil from an adjacent member while requiring a small number of members. In the coil apparatus according to the present invention, a retaining piece is formed at one end and a pair of coil terminals are formed at another end of a round coil constituted of a metal plate. A fitting wall at which the coil main body is fitted and first and second retaining portions formed by notching two portions of the fitting wall facing opposite each other are formed in the insulating case. The coil main body is fitted at the fitting wall of the insulating case, the coil terminals at one end of the coil are retained at the first retaining portion as the coil is turned and the coil is insulated from the core by retaining the retaining piece at the second retaining portion and thus preventing the coil from becoming lifted. The center of the coil constituted of a metal plate is aligned on a line extending from the central line passing the center of one of the pair of coil terminals along the widthwise direction.

9 Claims, 16 Drawing Sheets

COIL APPARATUS

BACKGROUND OF THE INVENTION

1. Field of the Invention

The present invention relates to a coil apparatus in an inductor, a transformer or the like such as a choke coil which is utilized in a switching power supply and the like.

2. Description of the Related Art

A one-turn coil constituted of a metal plate is used as a choke coil or a low-voltage side coil of a transformer in a switching power supply or the like with a large current capacity in the prior art. For instance, Japanese Unexamined Patent Publication No. 97054-1996 discloses a transformer constituted by utilizing such a metal plate. This transformer assumes a structure achieved by laminating a high-voltage side coil and a low-voltage side coil via an insulating case formed in a plate shape and housing the high-voltage side coil and the low-voltage side coil in a case-like insulating member.

In the coil apparatus in the prior art described above, various members must be provided for insulation, presenting a problem in that the number of required parts is bound to be large.

In addition, the coil apparatus disclosed in the publication mentioned above includes an internal circumferential coil terminal 51 of a flat-face coil 50 that is spirally wound provided on the flat-face coil 50, as shown in a sectional view presented in FIG. 8A. Reference numeral 52 indicates an external circumferential coil terminal of the flat-face coil 50.

The coil structure disclosed in the publication having the internal circumferential coil terminal 51 placed on the flat-face coil 50 has a large height h1, resulting in a poor space factor. This problem becomes even more pronounced if flat-face coils 50 are laminated as shown in FIG. 8B in a transformer with a large turn ratio, since the thickness h2 increases. In addition, the problem worsens in a transformer with a large power capacity constituted by using a thick wiring material.

The insulating case in the coil apparatus disclosed in the publication if adopts a double cylinder structure having one side along the axial direction left open with notches for leading out the coil terminals provided at two positions facing opposite each other at the outer cylinder. The high-voltage side coil, the low-voltage side coil and an insulating spacer are housed inside the insulating case. The main magnetic legs of the split cores are inserted at the inner cylinder of the insulating case, and the side magnetic legs are provided outside the outer cylinder of the insulating case. The bridging portion between the main magnetic legs and the side magnetic legs of one of the split cores is set facing opposite the high-voltage side coil via the insulating spacer in this structure.

In the coil apparatus in the prior art described above in which the low-voltage side coil and the high-voltage side coil are set facing opposite each other via the insulating spacer and the coil terminals and the core, too, are set facing opposite each other via the insulating spacer, the distance which only corresponds to the thickness of the insulating spacer can be assured for the insulating distance between the high-voltage side coil and the low-voltage side coil and as the insulating distance between the high-voltage side coil and the core. For this reason, the coil apparatus cannot be utilized in a transformer that requires a larger insulating distance between the high-voltage side coil and the low-voltage side coil or between the high-voltage side coil and the core for safety reasons or due to characteristics-related requirements.

Japanese Unexamined Patent Publication No. 335158/1993 discloses other examples of a coil and a transformer constituted by using a metal plate. The coil and the transformer adopt a structure achieved by preparing coils assuming various coil terminal shapes, sequentially connecting the coils via spacers so as to allow the connecting portions where the coils are connected turn around along the direction of the circumferences of the coils and laminating them via insulating sheets.

This coil apparatus in the prior art poses problems in that the number of parts is bound to be large since coils in various shapes are utilized and in that a larger space is required for the connections.

SUMMARY OF THE INVENTION

It is an object of the present invention to provide a coil apparatus that makes it possible to insulate a one-turn coil from an adjacent member while utilizing a smaller number of members by addressing the problems of the prior art discussed above.

It is a further object of the present invention to provide a power transformer provided with a spirally-wound coil that achieves a structure with a small height by improving the space factor of the coil.

It is a still further object of the present invention to provide a power transformer in which a sufficiently large insulating distance is assured between the high-voltage side coil and the low-voltage side coil and between the high-voltage side coil and the core.

The coil apparatus according to the present invention comprises a coil, an insulating case and a core. In the coil apparatus according to the present invention, the coil includes at least a one-turn coil constituted of a metal plate, the outer periphery is formed in a ring shape having a pair of coil terminals provided at one end thereof and a projecting retaining piece provided at another end thereof. The insulating case includes a plate member having a magnetic leg insertion hole at which main magnetic legs of the core is inserted, with a fitting wall at which the coil is fitted provided around a coil mounting surface at the plate member, notched portions provided at a coil terminal mounting side and the opposite side from the coil terminal mounting side at the fitting wall of the insulating case, a first retaining portion and a second retaining portion for retaining the coil provided at extended portions extending along the radial direction at the notched portions, the coil fitted in at the fitting wall and the coil terminal and the retaining piece of the coil respectively retained at the first retaining portion and the second retaining portion to prevent the coil from lifting off the insulating case. The core is constituted of split cores each having main magnetic legs, side magnetic legs and a bridging portion between the main magnetic legs and the side magnetic legs, with the main magnetic legs of the core inserted at the coil, the side magnetic legs set toward the external circumference of the insulating case and one bridging portion set facing opposite the coil over a distance.

In this structure, the 1-term coil constituted of a metal plate which is housed inside the insulating case is insulated on one side from other members that are adjacent to it such as the core, a coil and the like by the plate member of the insulating case. A sufficient gap is formed between the coil and another member, which may the core on the opposite side with the front end of the fitting wall of the insulating case coming in contact with the other member such as the core and insulation is achieved by the gap. As a result, the coil apparatus can be achieved without having to utilize an insulating sheet, i.e., with a smaller number of parts.

In addition, the coil apparatus according to the present invention assumes a structure in which the retaining piece at the coil is retained at the second retaining portion of the insulating case with a sufficient retaining margin to allow it to move along the rotational direction relative to the second retaining portion and the first retaining portion of the insulating case is used to retain at least either of the pair of coil terminals as the coil is turned.

In a structure which allows a coil terminal to be retained by rotating the coil as described above, the coil can be connected and retained at the insulating case through a simple process.

In addition, the coil apparatus according to the present invention may further comprise a bobbin and another coil wound around the bobbin. The bobbin includes a cylindrical winding drum and flanges formed at the two ends of the winding drum. The insulating case includes a side wall projecting out from an outer side of the plate member to the opposite side from the fitting wall to house the bobbin having the other coil wound around it inside the side wall, with the coil terminal of the other coil led out through a notched portion provided at the side wall of the insulating case.

In this structure, the one-turn coil and the other coil are insulated from each other by the plate member, the fitting wall and the side wall of the insulating case, achieving reliable insulation without requiring a special insulating member. In addition, the insulation between the other coil and the core, too, is assured without a special insulating member, since the bobbin having the other coil wound around it is enclosed by the side wall of the insulating case.

Alternatively, the coil apparatus according to the present invention may include at least two one-turn flat coils each constituted of a metal plate. The coils are each provided with a pair of coil terminals projecting outward from a main body, with one of the coil terminals in the pair formed so as to allow a line passing through the center of the coil terminal along the widthwise direction to pass the center of the coil. The two coils formed identically to each other are placed one on top of the other by setting one of the coils in reverse orientation, aligning its axis to the axis of the other coil and electrically insulating the one coil from the other to electrically connect the one coil terminal in the one coil to the one coil terminal in the other coil.

Since a two-turn coil is constituted by connecting identical coils with one of them reversed, it is not necessary to provide different types of coils, thereby achieving a reduction in the number of required parts and a reduction in the space required for connection.

In the coil apparatus according to the present invention described above, the main body of each coil assumes a toroidal shape.

By forming the coils in a toroidal shape as explained above, a coil apparatus which facilitates the assembly process of fitting the core with the section of the main magnetic leg formed in a cylindrical shape at the center of the coil is achieved.

The main bodies of the coils in the coil apparatus according to the present invention may also be formed in a toroidal shape with angular corners.

By forming the coils in a toroidal shape with angular corners in this manner, a coil apparatus which facilitates the assembly process when fitting cores with a section of the main magnetic legs formed in a polygonal shape at the center of the coil is achieved.

Furthermore, in the coil apparatus according to the present invention, the one-coil terminal in each coil includes a staged portion with a connecting portion to be connected with another coil provided at a flat surface different from the coil main body at the front end of the staged portion so that the two coils are coupled with another coil present between the coil main bodies.

In addition, according to the present invention, the different coil in the coil apparatus is a winding wound around a bobbin.

With a different coil provided in the space created between the coil main bodies by forming staged portions at the coil terminals, it becomes possible to constitute a coil apparatus having a plurality of windings such as a transformer.

In the coil apparatus according to the present invention, the other coil terminal in each of the coils includes a staged portion ranging over ½ of the thickness of the coil with a connecting portion to connect with another member provided at a flat surface different from the coil main body at the front end thereof, and the two coils are coupled with each other with the other coil terminals thereof set flush with each other.

This structure in which the other coil terminals constituting connecting terminals to be connected with other members are set flush with each other, the positions of the two coil terminals can be adjusted to the height of the connectors of the other members when, for instance, the coil apparatus is mounted on a substrate.

As a further alternative, the coil apparatus according to the present invention may comprise a bobbin, a high-voltage side coil, a low-voltage side coil and a core and constitute a power transformer. The bobbin includes a cylindrical winding drum and flanges formed at the two ends of the winding drum. The high-voltage side coil assumes a structure achieved by laminating in the axial direction flat-face coils spirally wound around the winding drum over two layers so as to allow the two-layer flat-face coils to sit continuous to each other on the internal circumferential side. The low-voltage side coil is constituted of a metal plate formed in a roughly U-shape and is set further outward relative to a flange. The core is constituted of split cores each having main magnetic legs, side magnetic legs and a bridging portion bridging between the main magnetic legs and the side magnetic legs, with the main magnetic legs of the core inserted at the winding drum, the side magnetic legs set on the external circumferential side of the flanges and the bridging portions and the side magnetic legs set so as to enclose at least parts of the high-voltage side coil and the low-voltage side coil.

This structure allows the coil terminals to be led out from the external circumference of the flat-face coils achieving a two-layer structure and thus, since the coil terminals are not placed the flat-face coils, the space factor is improved and the height does not increase. In addition, since the low voltage side coil is constituted as a one-turn coil by using a U-shaped metal plate, the low-voltage side coil has a low profile, and when this low-voltage side coil is coupled with the high-voltage side coil, a thin power transformer is realized.

In addition, in the coil apparatus according to the present invention, the winding drum includes a winding isolation piece projecting further outward relative to the external circumference of the cylindrical portion, and the flat-face coils are overlaid via the winding isolation piece.

By further providing the coil apparatus with a winding isolation piece at the winding drum of the bobbin and overlaying the flat-face coils via the winding isolation piece in this manner, any irregularities in the turns at the windings are prevented.

Furthermore, in the coil apparatus according to the present invention, low-voltage side coils may be set further outward relative to the flanges formed at the two ends of the winding drum.

By providing the low-voltage side coils on the outside of the two flanges at the bobbin around which the high-voltage side coil is wound as described above, the high-voltage side coil and the low-voltage side coils can be coupled with a higher degree of reliability to achieve a transformer with superior characteristics. In addition, since the low-voltage side coils are provided on the two sides of the bobbin, more options are afforded with regard to the connections of the low-voltage side coils to allow the coil apparatus according to the present invention to be adopted in conjunction with various types of converter transformers.

The coil apparatus according to the present invention may further comprise an insulating case that includes a first case and a second case each provided with a plate member having a magnetic leg insertion hole at which main magnetic legs of the core is inserted and a side wall formed almost perpendicular from an outer side of the plate member. The side walls of the first case and the second case overlap each other along the radial direction of the coils and each have a notched portion for a winding lead out. A terminal of the high-voltage side coil is led out through the notched portion with the insulating case covering the bobbin around which the high-voltage side coil is wound, the low-voltage side coil formed in a roughly U-shape is set on the outside of the plate member of at least either the first case or the second case of the insulating case, the main magnetic legs of the core inserted at the winding drum, the low-voltage side coil and the magnetic legs insertion holes of the insulating case and the side magnetic legs of the core are set on the outside of the side walls of the insulating case.

This structure further increases the creepage distance between the core and the low-voltage side coils and the creepage distance between the core and the high-voltage side coil to insulate them from each other with a higher degree of reliability.

Alternatively in the coil apparatus according to the present invention, the external circumference of each of the low-voltage side coils may be formed in a round shape, with a pair of coil terminals projecting out at one end of the external circumference and a retaining piece projecting out at another end. The coil apparatus further includes an insulating case that covers the bobbin, with the insulating case having a magnetic leg insertion hole provided at each of plate members to be set over the flanges of the bobbin. An outer surface of the insulating case located on the opposite side from the bobbin constitutes a low-voltage side coil mounting surface and a fitting wall at which the low-voltage side coil is fitted is provided around the mounting surface. Notched portions are formed at the fitting wall on the side where the coil terminals of the low-voltage side coils are mounted and also on the opposite side, and a first retaining portion and a second retaining portion for retaining the low-voltage side coil are provided at extended portions extending along the radial direction at the notched portions so that the low-voltage side coil is fitted at the fitting wall and the coil terminal of the low-voltage side coil and the retaining piece are retained at the first retaining portion and the second retaining portion to prevent the low-voltage side coil from lifting off the insulating case.

With the low-voltage side coil secured to the insulating case by adopting a structure through which the low-voltage side coil is prevented from becoming lifted by the retaining portions, a sufficient distance is assured between the low-voltage side coil and the core to achieve reliable insulation with ease without having to utilize a special member.

As a further alternative, the coil apparatus according to the present invention may comprise a bobbin, an insulating case, a high-voltage side coil, a low-voltage side coil and a core and may constitute a power transformer. The bobbin includes a cylindrical winding drum and flanges formed at the two ends of the winding drum. The high-voltage side coil, which is wound around the winding drum is housed together with the bobbin inside the insulating case. The insulating case includes a first case and a second case each provided with a plates member having a magnetic leg insertion hole at which main magnetic legs of the core is inserted and a side wall formed almost perpendicular from an outer side of the plate member. The side walls of the first case and the second case overlap each other along the radial direction of the coil and each have a notched portion for winding lead out. A terminal of the high-voltage side coil is led out through the notched portion with the insulating case covering the bobbin around which the high-voltage side coil is wound, and the low-voltage side coil which is constituted of a metal plate formed in a roughly U-shape is set on the outside of the plate member of at least either the first case or the second case. The core is constituted of split cores each having a main magnetic leg, the side magnetic legs and a bridging portion bridging between the main magnetic legs and the side magnetic legs, with the main magnetic legs of the core inserted at the winding drum, the low-voltage side coil and the magnetic leg insertion hole of the insulating case and the side magnetic legs of the core set further outward relative to the side wall of the insulating case.

This structure further increases the creepage distance between the core and the high-voltage side coil and the creepage distance between the low-voltage side coils and the high-voltage side coil, to insulate them from each other with a higher degree of reliability.

In addition, in the coil apparatus according to the present invention described above, low-voltage side coils may be provided outside the plate members of the first case and the second case.

By providing the low-voltage side coils on the outside of the two flanges of the bobbin around which the high-voltage side coil is wound as described above, the high-voltage side coil and the low-voltage side coils can be coupled with a higher degree of reliability to achieve a transformer with superior characteristics. In addition, since the low-voltage side coils are provided on the two sides of the bobbin, more options are afforded with regard to connections of the low-voltage side coils to allow the coil apparatus according to the present invention to be adopted in conjunction with various types of converter transformers.

Furthermore, in the coil apparatus according to the present invention, the external circumference of each of the low-voltage side coils is formed in a round shape with a pair of coil terminals projecting at one end of the external circumference and a retaining piece projecting out at the other end. The insulating case includes a fitting wall at which the low-voltage side coil is fitted is provided around a low-voltage side coil mounting surface, and notched portions are formed on a coil terminal mounting side on where a coil terminal of the low-voltage side coil is mounted and on the opposite side at the fitting wall of the insulating case, with a first retaining portion and a second retaining portion for retaining the low-voltage side coils provided at extended portions extending along the radial direction at the notched portions. The low-voltage side coil is fitted at the fitting wall and the coil terminals and the retaining piece of the low-voltage side coil are retained at the first retaining portion and the second retaining portion to prevent the low-voltage side coil from lifting off the insulating case.

With the low-voltage side coil secured to the insulating case by adopting a structure through which the low-voltage side coil is prevented from becoming lifted by the retaining portions, a sufficient distance is assured between the low-voltage side coil and the core to achieve reliable insulation without having to utilize a special member.

DETAILED DESCRIPTION OF THE PREFERRED EMBODIMENTS

Figure 1:
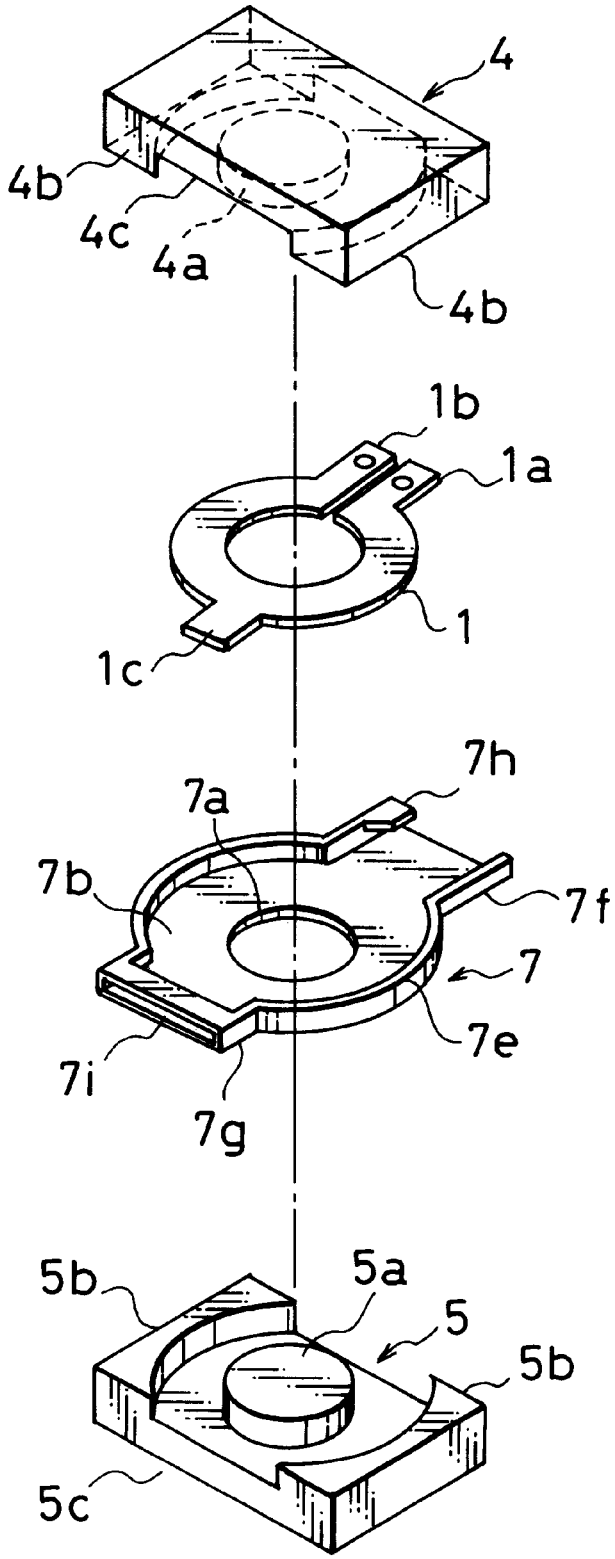
FIG. 1 is an exploded perspective illustrating an embodiment of the coil apparatus according to the present invention.
Figure 2A:
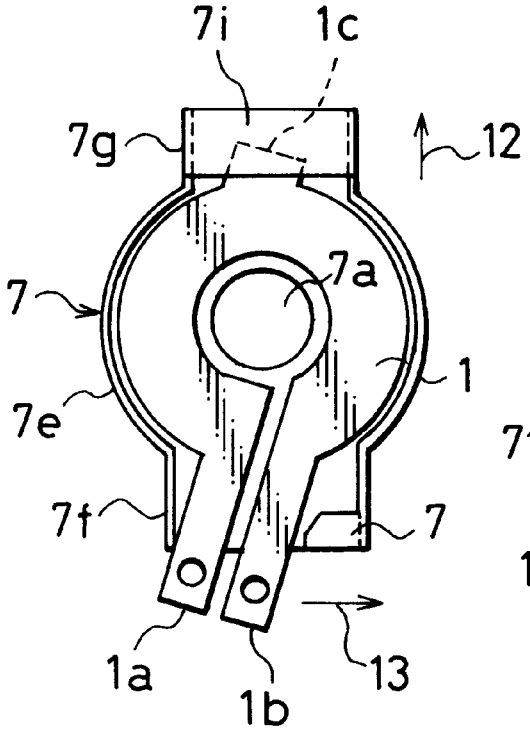
FIGS. 2A and 2B are provided to facilitate an explanation of the process for mounting a coil at the insulating case and FIG. 2C is a sectional view of the coil apparatus in the embodiment.
Figure 2B:
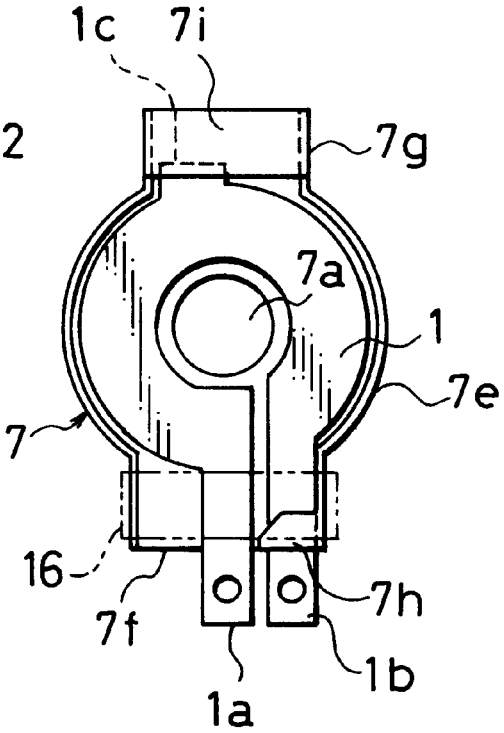
Figure 2C:
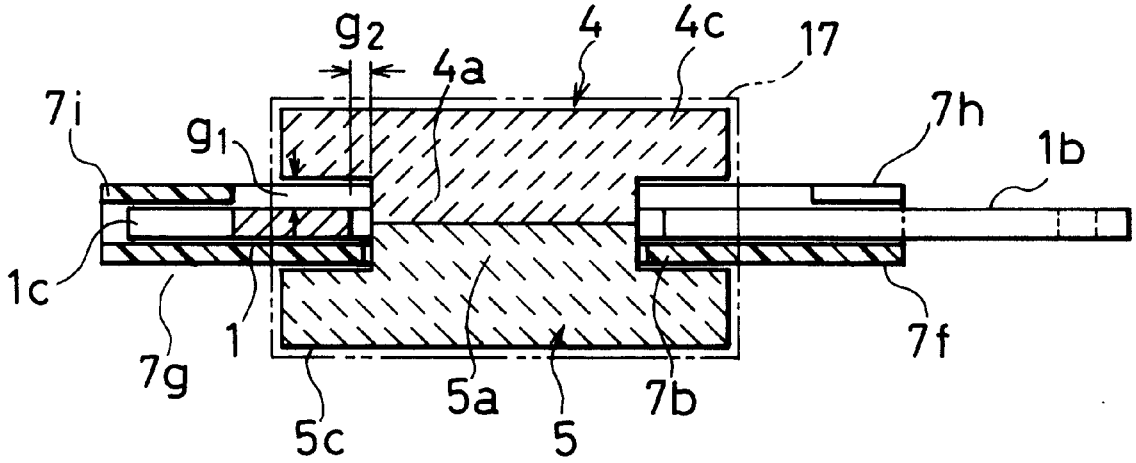

FIG. 1 is an exploded perspective illustrating an embodiment of the coil apparatus according to the present invention, FIGS. 2A and 2B are provided to facilitate an explanation of the process for mounting the coil at the insulating case and FIG. 2C is a sectional view of the coil apparatus in the embodiment. In FIGS. 1 and 2A through 2C, reference numeral 1 indicates a coil, reference numerals 4 and 5 each indicate a core and reference numeral 7 indicates an insulating case. The coil 1 is constituted of a metal plate formed in a roughly U-shape with its external circumference achieving a roughly toroidal (ring) shape. The external circumference of the coil 1 is formed in a round shape with a pair of coil terminals 1*a* and 1*b* projecting out at one end thereof and a retaining piece 1*c* projecting out roughly along the radial direction at the other end.

In the insulating case 7, one surface of a plate member 7*b* having a magnetic leg insertion hole 7*a* at which the magnetic legs of a core is inserted constitutes a mounting surface where the coil 1 is mounted. A around the mounting surface, a fitting wall 7*e* at which the coil 1 is fitted is provided. In addition, notched portions are formed at the fitting wall 7*e* of the case 7 on the side where the coil terminals 1*a* and 1*b* of the coil 1 are mounted and on the side opposite from the mounting side. Extended portions 7*f* and 7*g* each extending along the radial direction are provided at the notched portions. A first retaining portion 7*h* is provided at one of the extended portions, i.e., the extended portion 7*f*, and a second retaining portion 7*i* is provided at the other extended portion 7*g*.

The coil 1 is mounted at the case 7 as described below. As shown in FIG. 2A, the retaining piece 1*c* of the coil 1 is inserted as indicated by the arrow 12 at the second retaining portion 7*i* of the case 7 having a retaining margin relative to the retaining piece 1*c* along the direction in which the coil 1 rotates and then the ring portion of the coil 1 is fitted at the fitting wall 7*e*. Next, the coil 1 is rotated as indicated by the arrow 13 and, as shown in FIG. 2B, the coil terminal 1*b* of the coil 1 is made to slide into and is retained at the first retaining portion 7*h*. This prevents the coil 1 from lifting off the insulating case 7. Then the coil 1 is secured at the case 7 by using a tape 16 or an adhesive (not shown).

The core 4 and 5 in the embodiment which are E-type core respectively include main magnetic legs 4*a* and 5*a*, side magnetic legs 4*b* and 5*b* and bridging portions 4*c* and 5*c* bridging between the main magnetic legs 4*a* and 5*a* and the side magnetic legs 4*b* and 5*b*. As shown in FIG. 2C, the main magnetic leg 5*a* of one of the core 4 and 5, i.e., the core 5, is inserted at the magnetic leg insertion hole 7*a* of the insulating case 7 and also within the coil 1. In addition, the side magnetic legs 4*b* and 5*b* are set on the outside of the fitting wall 7*e* and the bridging portion 4*c* is placed in contact with the front end of the fitting wall 7*e* to face opposite the coil 1 over a distance. It is to be noted that the core 4 and are secured to each other by using a tape 17 or through bonding. The core 4 and 5 may be secured to each other by using a retaining fixture constituted of a metal or the like which is also used to secure the coil apparatus to the chassis or the like of an electrical device, instead.

By adopting the structure in which the coil 1 is secured to the insulating case while ensuring that it is not allowed to lift from the insulating case 7 with the retaining portions 7*h* and 7*i* in this manner, a gap g1 is created between the coil 1 and the bridging portions 4*c* of the core 4, as shown in FIG. 2C. Consequently, it becomes possible to achieve insulation without having to use a special insulating member to achieve a reduction in the number of required parts. It is to be noted that the coil 1 is positioned at the insulating case 7 fitting in the coil 1 at the fitting wall 7*e*. In addition, the position of the core 5 is determined by fitting in the main magnetic legs 5*a* at the magnetic leg insertion hole 7*a*. Since the internal diameter of the coil 1 is set larger than the diameter of the main magnetic legs 4*a* and 5*a* in the structure, a gap g2 is formed between the main magnetic legs 4*a* and 5*a* and the internal circumference of the coil 1 as well.

Furthermore, by fitting in the coil 1 at the fitting wall 7*e* and then rotating the coil 1 as in the embodiment, the coil terminal 1*b* is retained at the retaining portion 7*h* to facilitate the retaining process.

It is to be noted that while the coil terminals 1*a* and 1*b* are electrically connected to another electrical part or a power line, the heat radiation of the coil apparatus is promoted by securing them to the chassis or the like of an electrical device via an insulating member achieving good thermal conductivity. In addition, by distending areas near the coil terminals 1*a* and 1*b* or other areas and thus by increasing the surface area, an even better heat radiation effect is realized.

Figure 3:
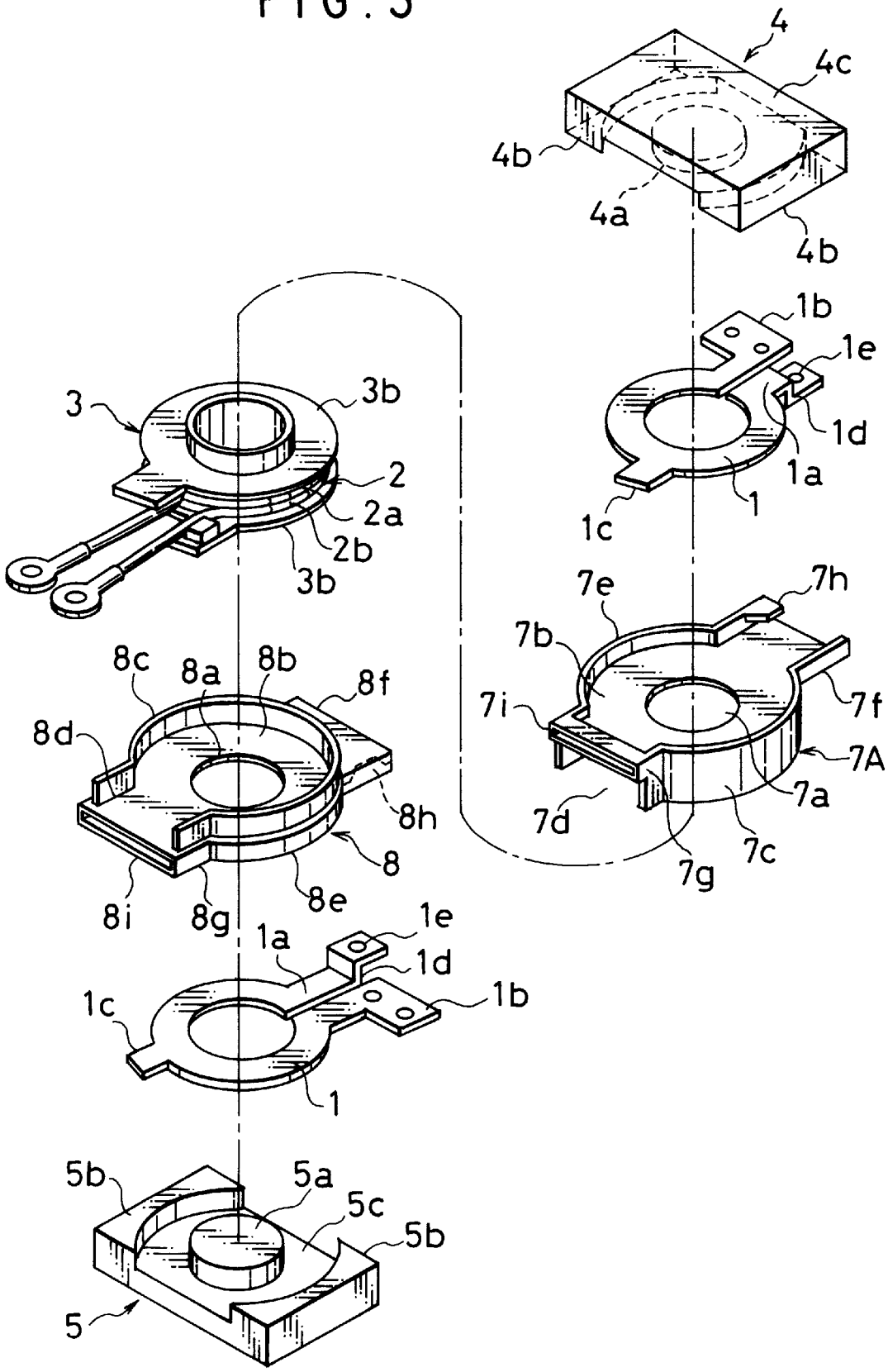
FIG. 3 is an exploded perspective of another embodiment of the coil apparatus according to the present invention.
Figure 4A:
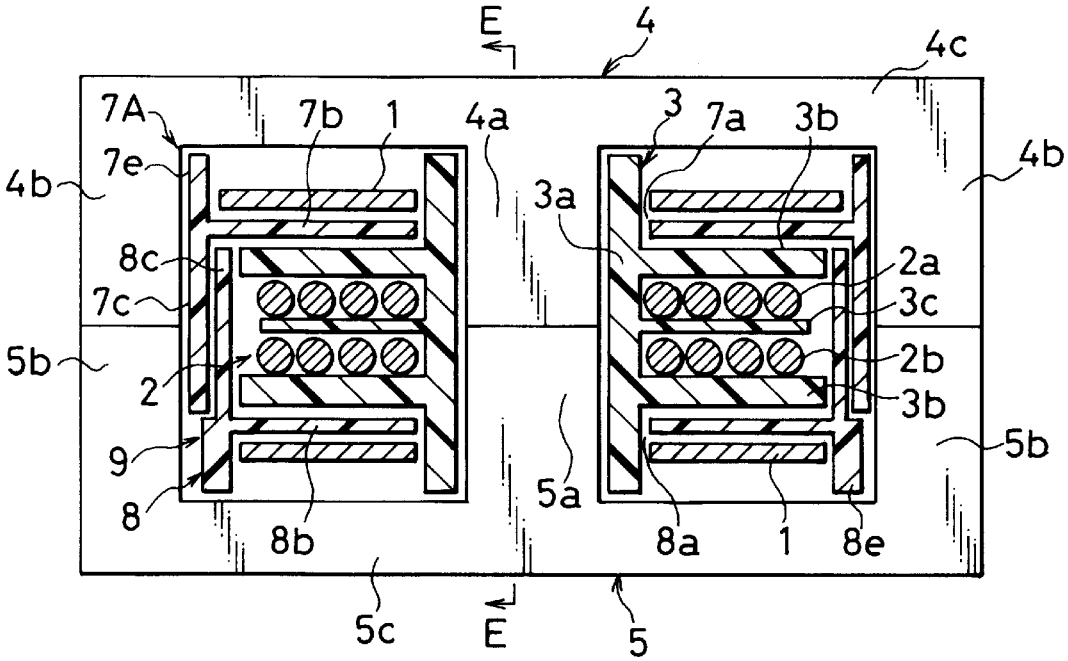
FIG. 4A is a sectional view of the coil apparatus in FIG. 3
Figure 4B:
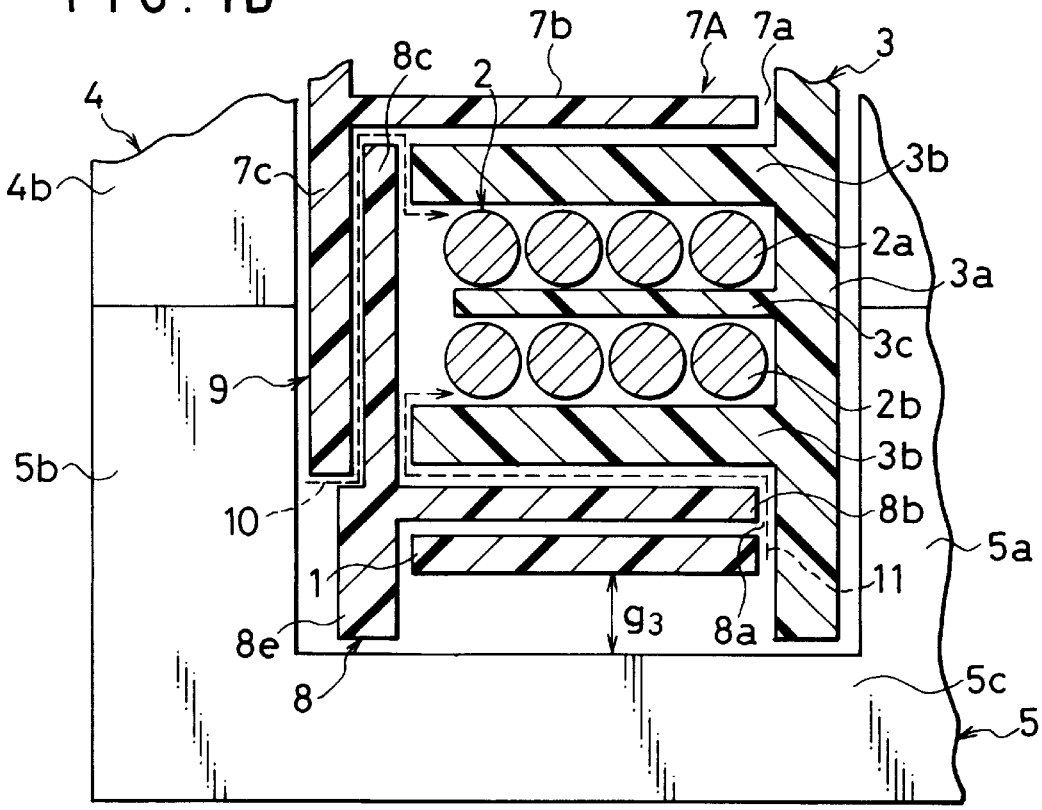
FIG. 4B is an enlarged sectional view of part of the sectional view presented in FIG. 4A.
Figure 5A:
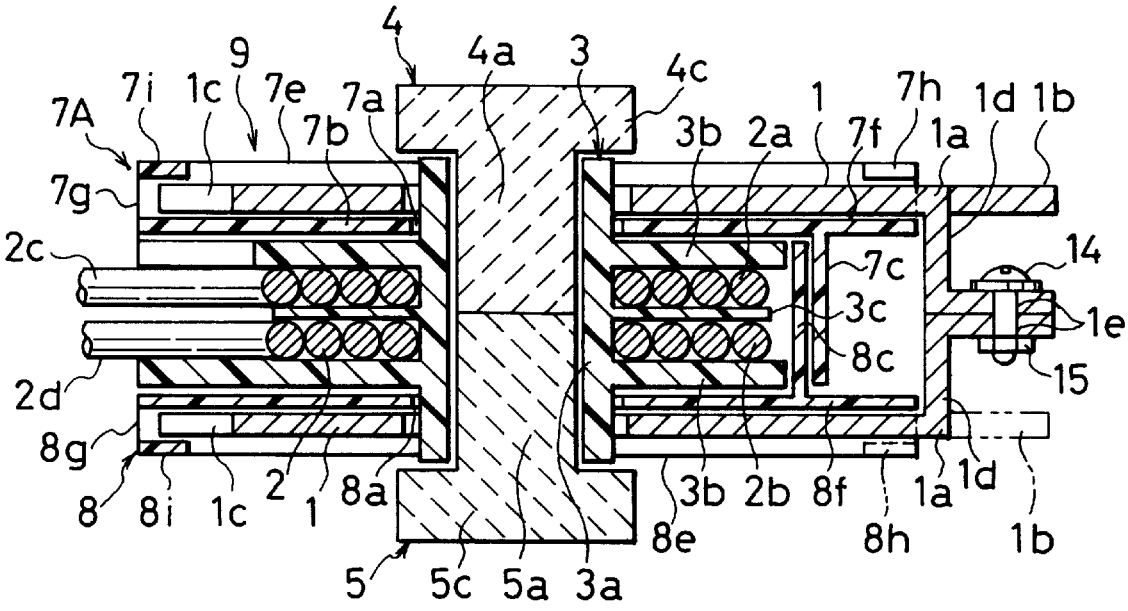
FIG. 5A is a sectional view taken along E-E in FIG. 4A and FIGS. 5B and 5C are plan views of the process for mounting the low-voltage side coil at the insulating case.
Figure 5B:
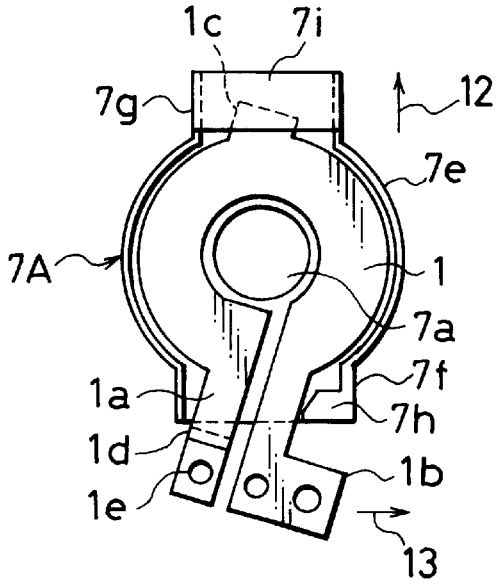
Figure 5C:
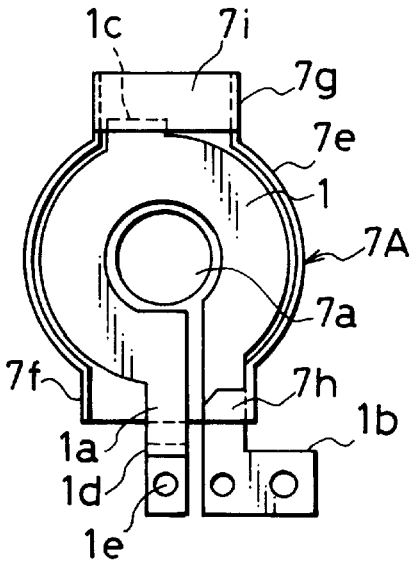

FIG. 3 is an exploded perspective of another embodiment of the coil apparatus according to the present invention adopted in a power transformer, FIG. 4A is a sectional view of the coil apparatus in FIG. 3, FIG. 4B is an enlarged sectional view of part of FIG. 4A. FIG. 5A is a sectional view taken along E-E in FIG. 4A and FIGS. 5B and 5C are plan views of the process for mounting the low-voltage side coil at the insulating case. This embodiment is achieved by providing a split-type insulating case 9 constituted of a first case 7A which is a variation of the insulating case 7 explained earlier and a second case 8. In addition, coils 1 each constituted of a metal plate are utilized as low-voltage side coils and another coil 2 with a greater number of turns is utilized as a high-voltage side coil in this embodiment.

The first case 7A and the second case 8 respectively include plate members 7*b* and 8*b* having magnetic legs insertion holes 7*a* and 8*a* through which the main magnetic legs 4*a* and 5*a* of the core 4 and 5 are inserted respectively, and side walls 7*c* and 8*c* formed almost perpendicular from the outer sides of the plate members 7*b* and 8*b*. The side wall 7*c* of the first case 7A and the side wall 8*c* of the second case 8 achieve a cylindrical structure by overlapping each other along the direction of the radius of the high-voltage side coil 2 and respectively include notched portions 7*d* and 8*d* for winding lead out.

In the transformer having this insulating case 9, the first case 7A and the second case 8 are placed over a bobbin 3 having the high-voltage side coil 2 wound around it and the terminals are led out through the notched portions 7*d* and 8*d*. In addition, the U-shaped low-voltage side coils 1 are set on the outside of the plate members 7*b* and 8*b* of the first case 7A and the second case 8. While the low-voltage side coils 1 are provided on the two sides of the insulating case in this embodiment, a low-voltage side coil 1 may be provided only on either side, instead.

The core 4 and 5 are mounted with the main magnetic legs 4*a* and 5*a* inserted at the winding drum 3, the low-voltage side coils 1 and the magnetic legs insertion holes 7*a* and 8*a* of the first case 7A and the second case 8 and the side magnetic legs 4*b* and 5*b* set on the outside of the side walls 7*c* and 8*c*.

In this embodiment, too, the external circumference of each low-voltage side coil 1 is formed in a round shape with a pair of coil terminals 1*a* and 1*b* projecting out at one end thereof and a retaining piece 1*c* projecting almost along the radial direction provided at the other end, as illustrated in FIGS. 3, 5B and 5C.

The outer surfaces of the plate members 7*b* and 8*b* on the side opposite from the bobbin 3 constitute mounting surfaces at which the low-voltage side coils 1 are mounted, with fitting walls 7*e* and 8*e* at which the low-voltage side coils 1 are fitted provided around the mounting surfaces. In addition, notched portions are formed at the fitting walls 7*e* and 8*e* of the cases 7A and 8 on the mounting sides where the coil terminals 1*a* and 1*b* of the low-voltage side coils 1 are mounted and on the sides opposite from the mounting side. At these notched portions, extended portions 7*f* and 7*g*, and 8*f* and 8*g* extending along the radial direction are formed. First retaining portions 7*h* and 8*h* are provided at the extended portions 7*f* and 8*f* on one side and second retaining portions 7*i* and 8*i* are provided at the extended portions 7*g* and 8*g* on the other side.

When mounting the low-voltage side coils 1 at the cases 7A and 8, the retaining pieces 1*c* of the low-voltage side coils 1 are inserted at the second retaining portions 7*i* and 8*i* as indicated by the arrow 12, as illustrated in FIG. 5B, which shows the case 7A for an example. Next, the ring portions of the low-voltage side coils 1 are fitted in at the fitting walls 7*e* and 8*e*. Then, the coils 1 are rotated as indicated by the arrow 13, and by sliding and the coil terminals 1*b* of the low-voltage side coils 1 into the first retaining portions 7*h* and 8*h* as shown in FIG. 5C, the low-voltage side coils 1 are prevented from lifting off the cases 7A and 8. Then the low-voltage side coils are secured to the cases 7A and 8 with a tape or adhesive (not shown). A retaining fixture constituted of metal or the like used to secure the coil apparatus to the chassis or the like of an electrical device may also be utilized to secure the cases 7A and 8 to each other instead.

It is to be noted that in the embodiment, one of the pair of coil terminals, i.e., the coil terminal 1*a* of each low-voltage side coil is formed to extend outward along the radial direction from the center of the low-voltage side coil, with a staged portion 1*d* provided in its middle and a connecting hole 1*e* provided at a position further toward the front end relative to the staged portion 1*d* as shown in FIG. 5B. This structure allows two identical low-voltage side coils 1 to be coupled by a screw 14 and a nut 15, by rotating them in opposite directions and setting them one on top of the other as shown in FIG. 5A. As a result, a gap for mounting the bobbin 3 having the high-voltage side coil the high-voltage side coil 2 wound around it is formed between the two coils 1.

As described above, by adopting the structure in which the low-voltage side coils 1 are secured to the insulating case while retaining the low-voltage side coils 1 with the retaining portion 7*h* and 8*h* and 7*i* and 8*i* to ensure that the low-voltage side coils 1 are not allowed to become lifted, a gap g3 is ensured between the low-voltage side coils 1 and the core 4 and 5 as shown in FIG. 4B to achieve insulation without having to utilize a special utilizing member thereby reducing the number of required parts.

In addition since the low-voltage side coils 1 each constituted of a one-turn coil are also insulated from another coil, i.e., the high-voltage side coil 2, which is adjacent to them by the plate members 7*b* and 8*b*, the fitting walls 7*e* and 8*e* and the side walls 7*c* and 8*c* of the cases 7A and 8, reliable insulation is achieved without having to utilize a special insulating members. Furthermore, since the bobbin 3 wound with the high-voltage side coil 2 is enclosed by the side walls 7*c* and 8*c* of the cases 7A and 8, the insulation between the high-voltage side coil 2 and the core 4 and 5 is assured without having to use a special insulating member.

In the embodiment, a long creepage distance is assured between the high-voltage side coil 2 and the side magnetic legs 4*b* and 5*b* of the core 4 and 5 on the external circumferential sides of the low-voltage side coils 1 as indicated by the dotted line 10 in FIG. 4B, due to the area over which the side walls 7*c* and 8*c* of the first case 7A and the second case 8 of the insulating case 9 overlap each other. In addition, a long creepage distance is assured between the high-voltage side coil 2 and the bridging portions 4*c* and 5*c* of the cores 4 and 5 on the internal circumferential sides of the low-voltage side coils 1 as indicated by the dotted line 11, due to the areas over which the plate members 7*b* and 8*b* of the first case 7A and the second case 8 overlap the flanges 3*b* of the bobbin 3. Consequently, these members can be insulated from each other with a high degree of reliability.

In addition, since two identical coils can be used as the low-voltage side coils 1, only one type of coils are needed as the low-voltage side coils 1 to achieve a reduction in the number of required parts.

The present invention may be adopted in conjunction with E-I type core, U-U type core and U-I type core as well as E-E type core.

Figure 6A:
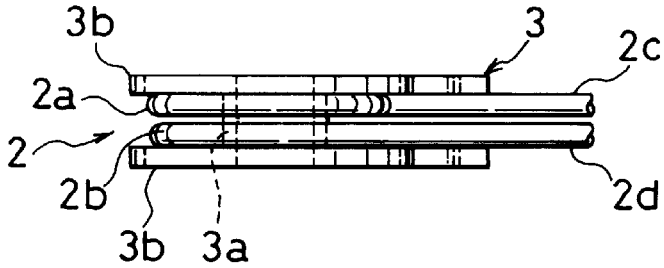
FIG. 6A presents a side elevation of the high-voltage side coil utilized in the embodiment presented in FIGS. 3, 4A and 4B and FIGS. 6B through 6D show winding steps taken to achieve the high-voltage side coil.

Next, the structure adopted to wind the high-voltage side coil 2 around the bobbin 3 is explained. FIG. 6A is a side elevation showing an ideal winding structure adopted in conjunction with the high-voltage side coil 2 in the present invention. As shown in FIG. 6A, the bobbin 3 includes flanges 3*b* at the ends of a cylindrical winding drum 3*a*. The two, which is constituted of flat-face coils 2*a* and 2*b* provided over two layers and wound spirally around the winding drum 3*a* of the bobbin 3 and the flat faced coils 2*a* and 2*b* are set one on top of the other along the axial direction continuously to each other on the internal circumferential side. Lead out coil terminals 2*c* and 2*d* of the flat-face coils 2*a* and 2*b* are led out from the external circumferential sides of the flat-face coils 2*a* and 2*b*.

Figure 6B:
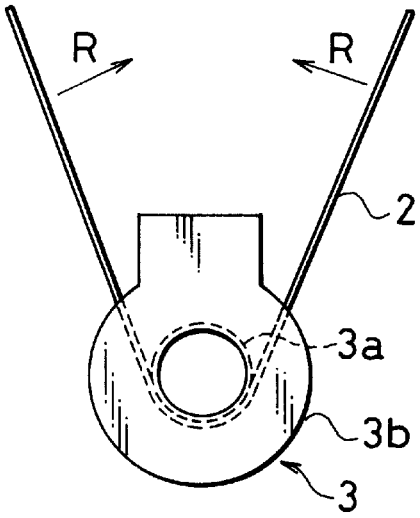
Figure 6C:
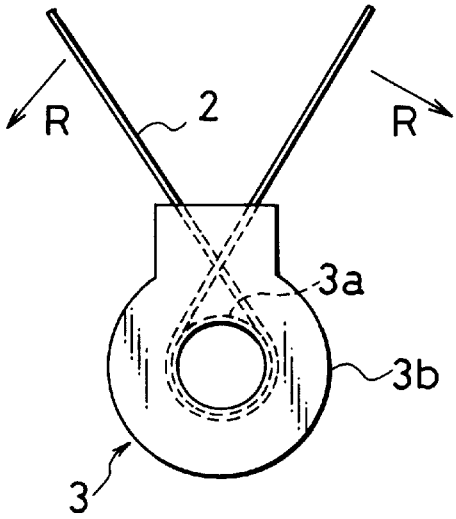
Figure 6D:
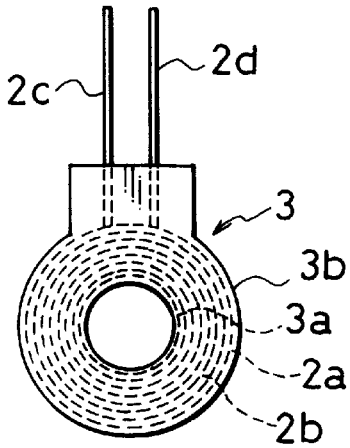

As illustrated in FIGS. 6B through 6D, the high-voltage side coil 2 is constituted by winding a single wiring material 2 around the winding drum 3*a* of the bobbin 3 and winding a wiring material 2 around the winding drum 3*a* as indicated by the arrows R in two directions at the same time. Through this winding process, the flat-face coils 2*a* and 2*b* are formed over two layers one on top of the other at the same time.

Figure 8A:
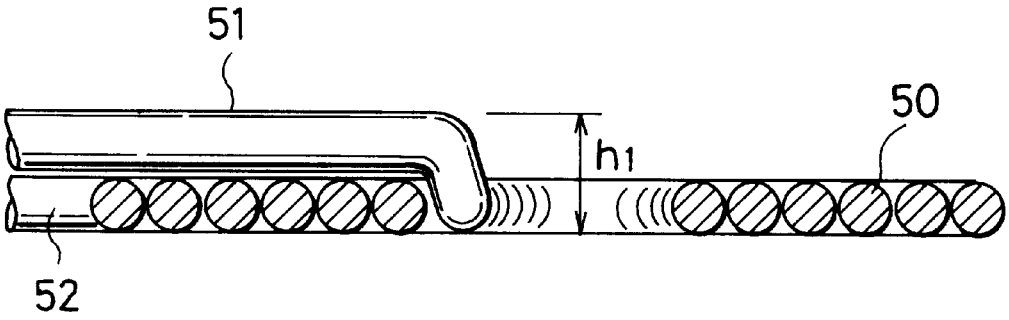
FIGS. 8A and 8B present sectional views of spirally wound coils in the prior art.
Figure 8B:
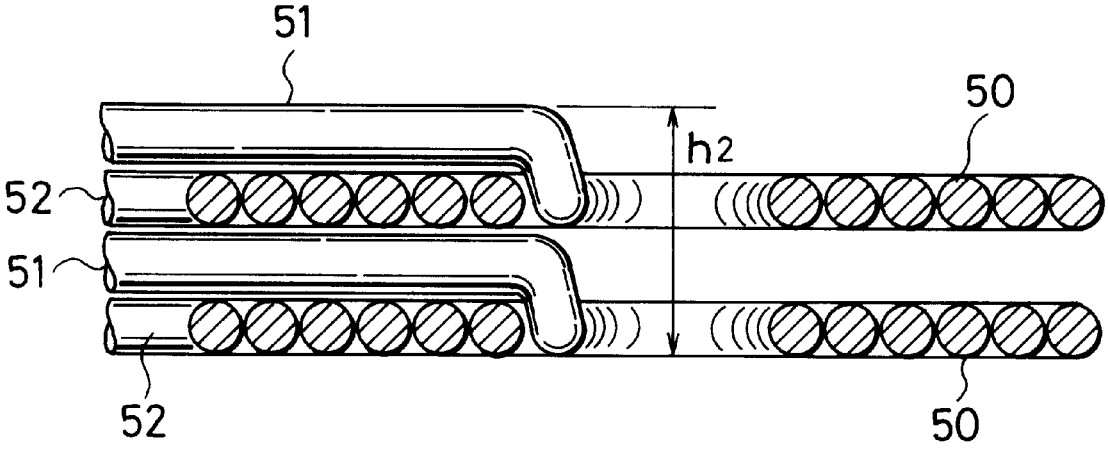

In this structure, the thickness of the high-voltage side coil 2 is equal to the total of the thicknesses of the flat-face coils 2*a* and 2*b* provided over two layers which are individually wound spirally. As a result, the total thickness of he flat-face coils does not greatly increase due to the presence of the lead out portion 51 as in the structure adopted in the prior art illustrated in FIGS. 8A and 8B to improve the space factor, and thus, the thickness does not increase even when the flat-face coils are set one up on top of the other over two layers.

In addition, while the value of the electrical current flowing through the low-voltage side coils 1 is high, the low-voltage side coils 1 are each constituted as a one-turn coil by using a U-shaped metal plate, and by combining the high-voltage side coil 2 and the low-voltage side coils 1 described above, a low profile power transformer is achieved.

Figure 7A:
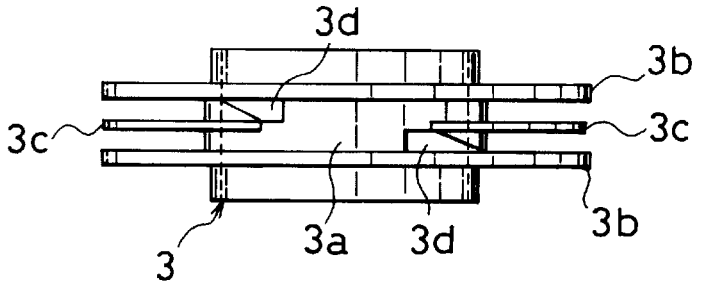
FIG. 7A is a view taken from the side where the high-voltage side coil is led out of an example of an ideal bobbin to be utilized to implement the present invention.
Figure 7B:
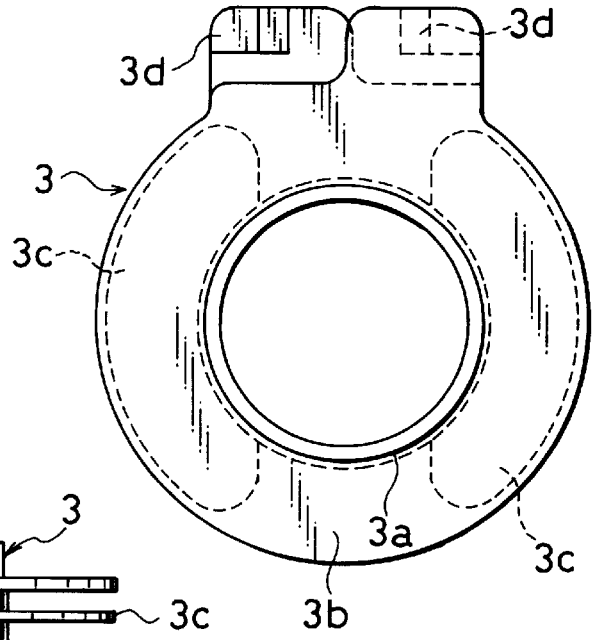
FIG. 7B is a plan view of the bobbin.
Figure 7C:
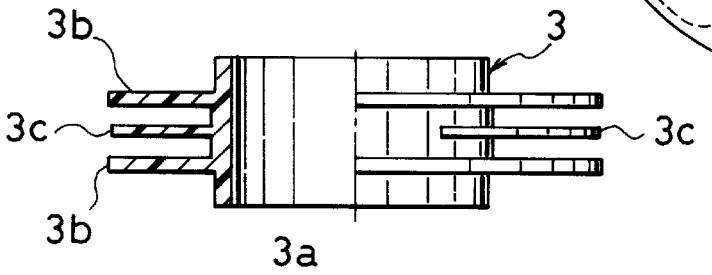
FIG. 7C is a half sectional view taken from the opposite side from FIG. 7A
Figure 7D:
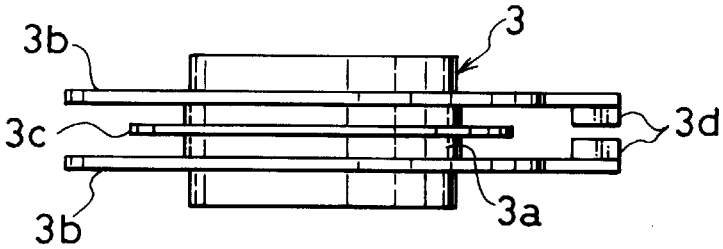
FIG. 7D is its side elevation.

FIG. 7A is a view of an example of an ideal bobbin to be utilized to implement the present invention taken from the side where the high-voltage side coil is led out. FIG. 7B is a plan view, FIG. 7C is a half sectional view taken from the opposite side from FIG. 7A and FIG. 7D is its side elevation. This bobbin 3 includes windings isolation piece 3*c* projecting outward from the external circumference of the cylindrical winding drum 3*a* at two sides which are not the winding lead out portion and the side opposite from the winding lead out portion. By providing the winding isolation pieces 3*c* and setting the flatface coils 2*a* and 2*b* one on top of the other via the winding isolation pieces 3*c* in this manner, the winding material is not wound irregularly. It is to be noted that reference numeral 3*d* indicates a retaining projection provided at the inner surface of a flange 3*b* to prevent the coil terminals 2*c* and 2*d* from becoming disengaged.

Figure 9:
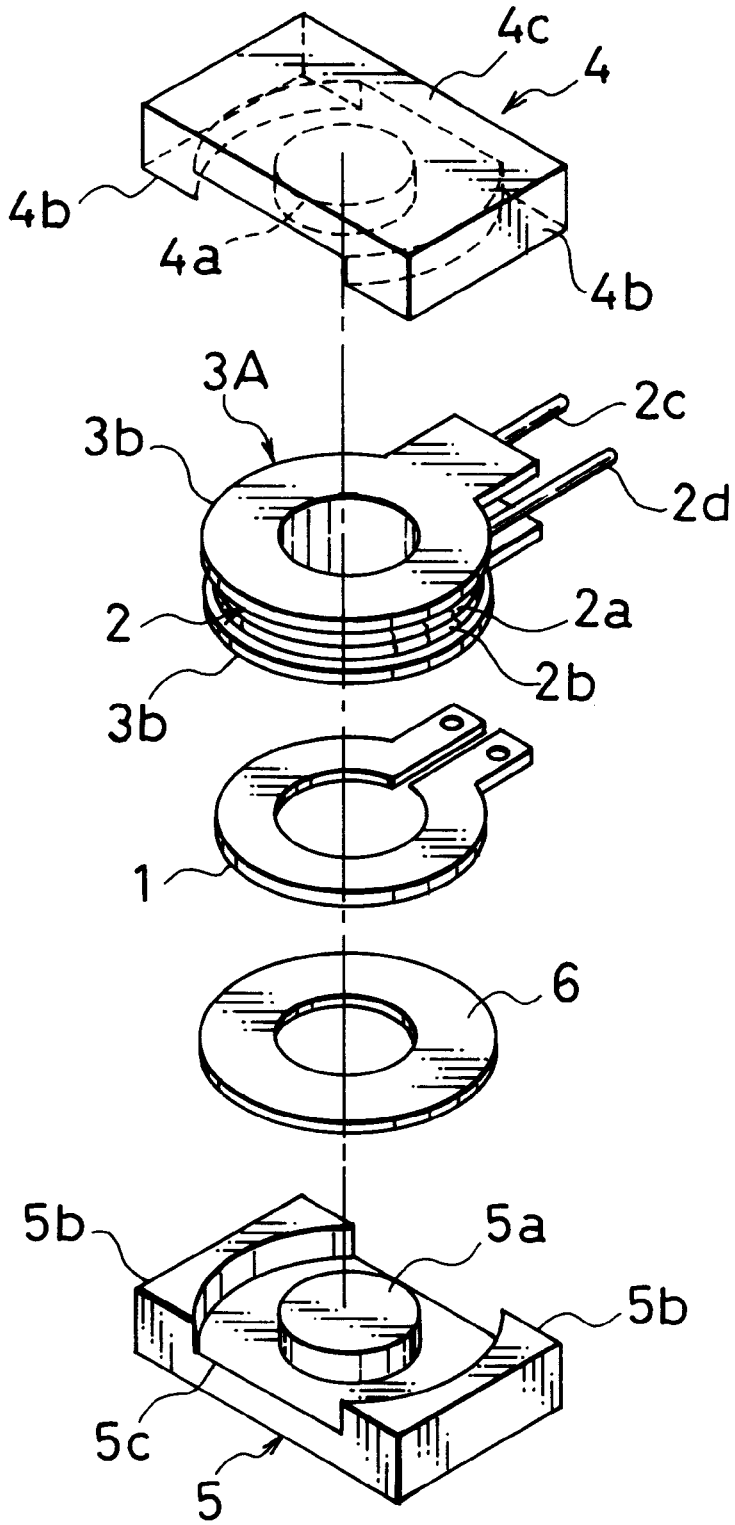
FIG. 9 is an exploded perspective of yet another embodiment of the coil apparatus according to the present invention.
Figure 10A:
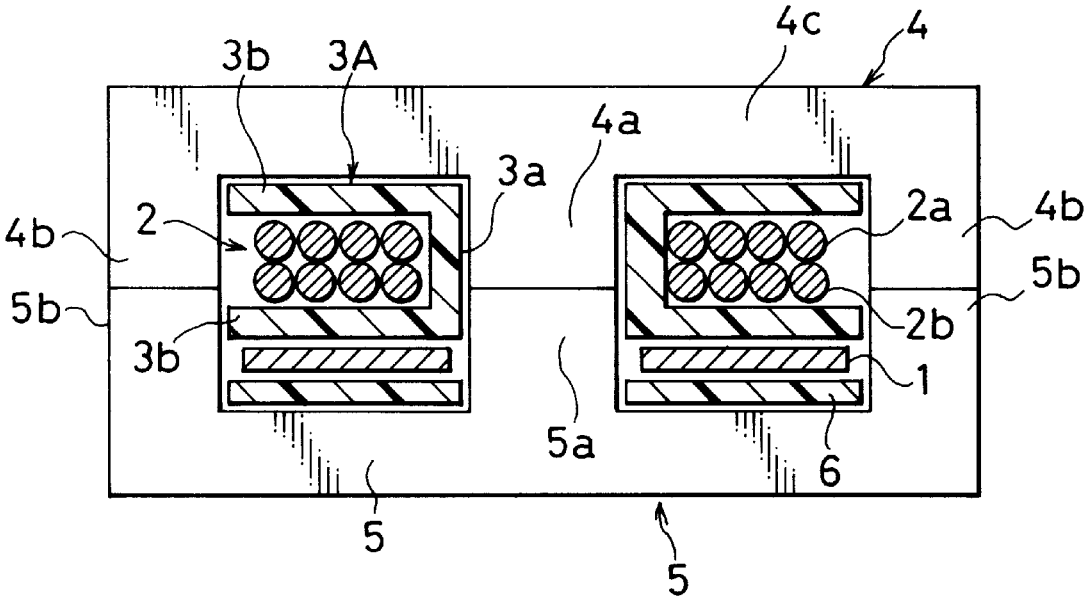
FIG. 10A is a sectional view of the coil apparatus in FIG. 9

FIG. 9 is a perspective of a coil apparatus in another embodiment of the present invention achieved by adopting the winding structure illustrated in FIG. 6 and FIG. 10A is its sectional view. In FIGS. 9 and 10A, reference numeral 1 indicates a low-voltage side coil, reference numeral 2 indicates a high-voltage side coil, reference numeral 3A indicates a bobbin having the high-voltage side coil 2 wound around it, reference numerals 4 and 5 each indicates a core and reference numeral 6 indicates an insulating plate provided between the core 4 and the low-voltage side coil 1.

The high-voltage side coil 2 is constituted of flat-face coils 2*a* and 2*b* provided over two layers which are wound spirally around a winding drum 3*a* of the bobbin 3A. These flatface coils 2*a* and 2*b* are set one on top of the other along the axial direction continuously to each other on the internal circumferential side. Lead out coil terminals 2*c* and 2*d* of the flat-face coils 2*a* and 2*b* are led out from the external side of the flat-face coils 2*a*.

The low-voltage side coil 1 constituted of a metal plate formed in a roughly U-shape is set on the outside one of the flanges 3*b* as shown in FIG. 10A.

The core 4 and 5 in the embodiment are each constituted of an E-type core and are respectively provided with main magnetic legs 4*a* and 5*a*, side magnetic legs 4*b* and 5*b* and bridging portions 4*c* and 5*c* bridging between the main magnetic legs 4*a* and 5*a* and the side magnetic legs 4*b* and 5*b*. The main magnetic legs 4*a* and 5*a* of these core 4 and 5 are inserted at the cylindrical winding drum 3*a*, the side magnetic legs 4*b* and 5*b* are set on the external circumferential sides of the flanges 3*b* and the bridging portions 4*c* and 5*c* and the side magnetic legs 4*b* and 5*b* are set so as to enclose at least parts of the high-voltage side coil 2 and the low-voltage side coil 1 to constitute a closed magnetic passage.

By adopting this structure, in which the thickness of the high-voltage side coil 2 is the total of the thicknesses of the flatface coils 2*a* and 2*b* provided over two layers which are individually wound in a spiral, the total thickness of the flat-face coils does not increase greatly due to the presence of the lead out portion as is the case in the prior art, to improve the space factor and to ensure that the thickness does not increase even when the flat-face coils are placed one on top of the other over two layers. In addition, while the value of the electrical current flowing through the low-voltage side coil 1 is high, the low-voltage side coil 1 is constituted as a one-turn coil by using a U-shaped metal plate, a thin power transformer is achieved through a combination of the high-voltage side coil 2 and the low-voltage side coil 1 described above.

Figure 10B:
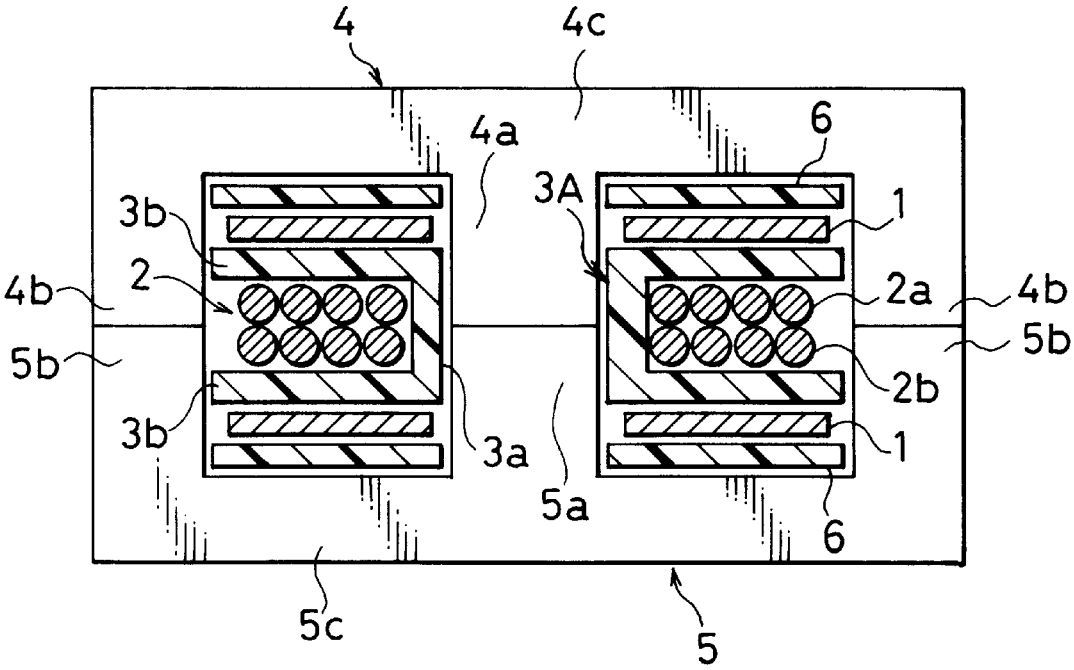
FIG. 10B is a sectional view of another embodiment of the present invention.

FIG. 10B is a sectional view of another embodiment of the coil apparatus according to the present invention, in which low-voltage side coils 1 are provided on the outside of the flanges 3*b* formed at the two ends of the winding drum 3*a* of the bobbin 3A.

This structure achieves better coupling of the high-voltage side coil 2 and the low-voltage side coils 1 and, as a result, a transformer with outstanding characteristics is obtained. In addition, since the low-voltage side coils 1 are provided on the two sides of the bobbin 3A, a wide range of options is afforded with regard to the connections of the low-voltage side coils 1 to allow the coil apparatus to be adopted in various types of converter transformers.

Figure 11:
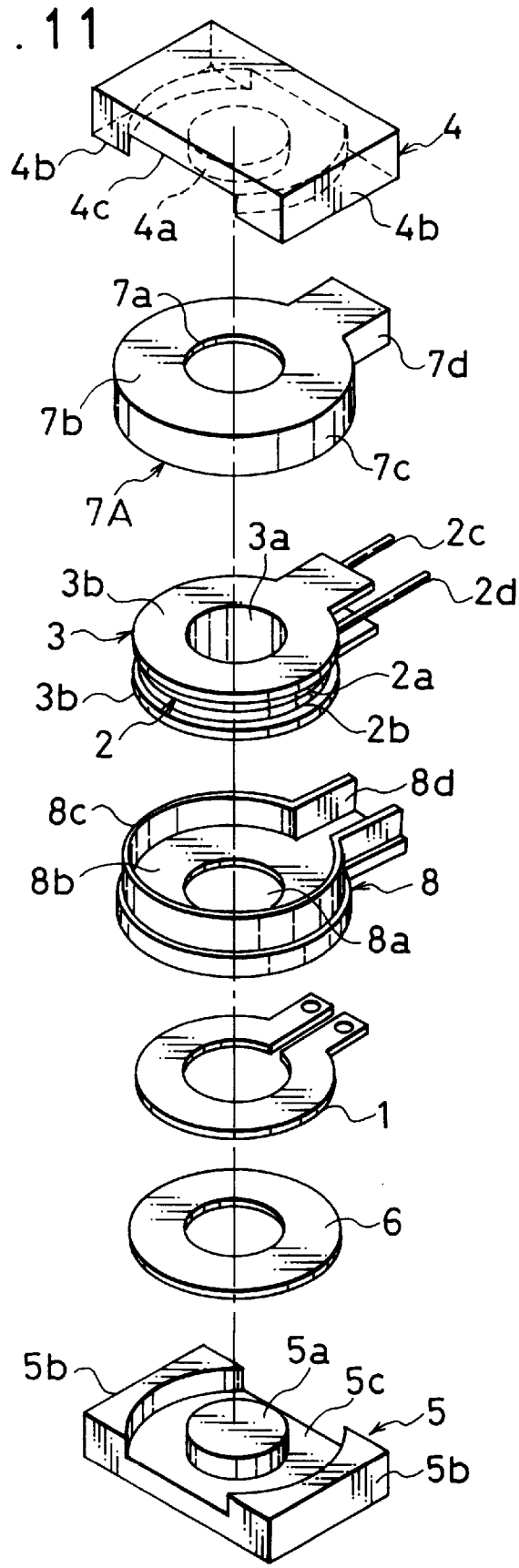
FIG. 11 is an exploded perspective of yet another embodiment of the coil apparatus according to the present invention.
Figure 12:
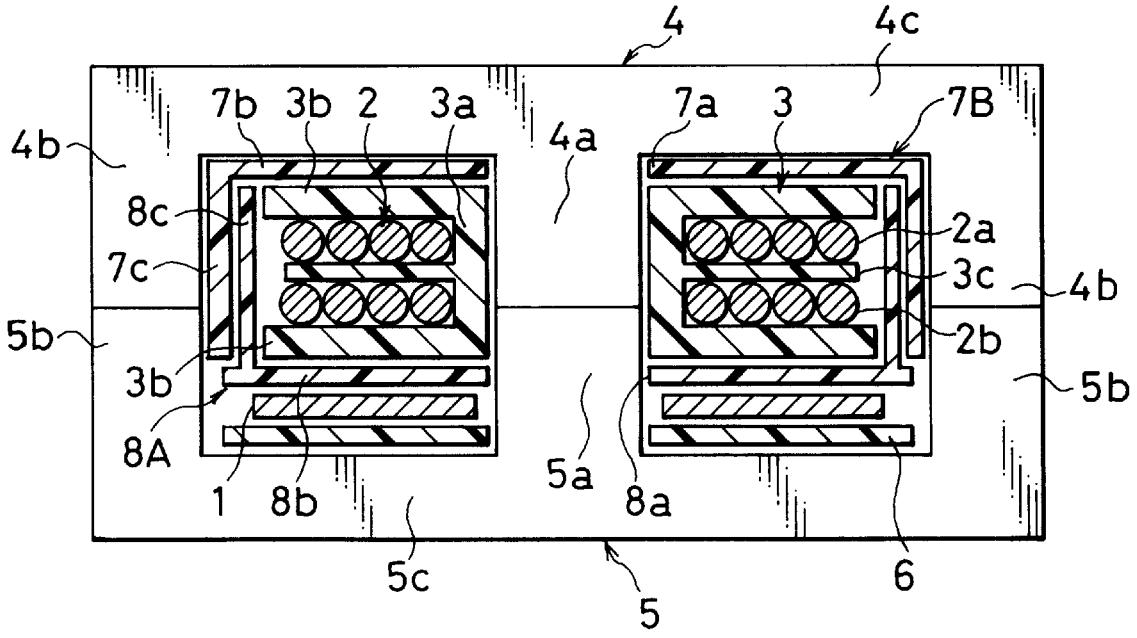
FIG. 12 is a sectional view of the coil apparatus shown in FIG. 11.

FIG. 11 is a perspective of a coil apparatus achieved in another embodiment of the present invention by adopting the winding structure shown in FIGS. 6A through 6C, utilizing the bobbin shown in FIGS. 7A through 7D and providing an upper case 7B and a lower case 8A. FIG. 12 is its sectional view.

The coil apparatus shown in FIGS. 11 and 12 differs from the coil apparatus in FIGS. 3, 4A, 4B and 5A explained earlier in that it includes only a single low-voltage side coil 1 provided on one side and in that the coil apparatus does not include the retaining structure to retain the low-voltage side coil 1. Otherwise, its structural features are identical to those explained earlier. As in the previous embodiments, the side walls 7*c* and 8*c* are allowed to overlap along the radial direction to achieve reliable insulation, as well.

In this embodiment, too, flat-face coils 2*a* and 2*b* are formed over two layers, and by setting the flat-face coils 2*a* and 2*b* one on top of the other, the coil terminals 2*c* and 2*d* are formed without setting the lead out portion over the flat-face coils, i.e., without increasing the height, to improve the space factor. This, combined with the low-voltage side coil 1 constituted of a metal plate, makes it possible to achieve a low profile coil apparatus. In addition, since a winding isolation piece 3*c* is provided, the flat-face coils 2*a* and 2*b* set one on top of the other via the winding isolation piece 3*c* do not manifest and irregularity in the winding.

FIG. 13 presents circuit diagrams of examples of converter circuits in which the coil apparatus according to the present invention may be adopted. The transformer according to the present invention constitutes an ideal converter transformer for an electrical part mounted on an electric car that converts a 200 V~400 V input to the high-voltage side coil to a 12V voltage. In the examples presented in FIGS. 13A and 13B, the structure illustrated in FIGS. 11 and 12 may be adopted by using the high-voltage side coil 2 as an input-side coil and the coil 1 as an output-side coil. In addition, even when there are two low-voltage side coils 1 as in the transformer achieved in the structure illustrated in FIGS. 13A or 13B by connecting in parallel the two low-voltage side coils 1.

Figure 13A:
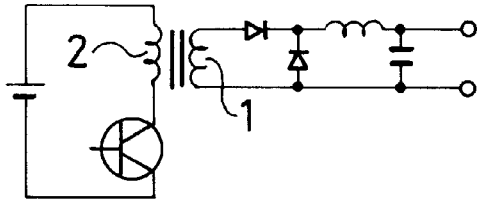
FIGS. 13A through 13E present diagrams of circuits in which the present invention may be adopted.
Figure 13B:
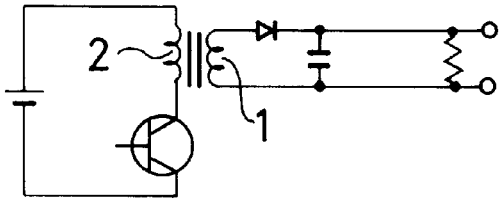
Figure 13C:
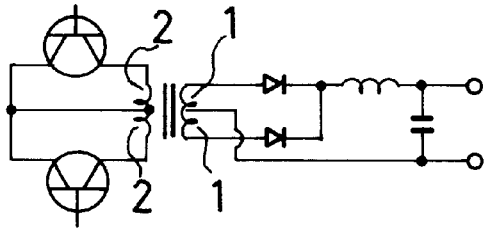
Figure 13D:
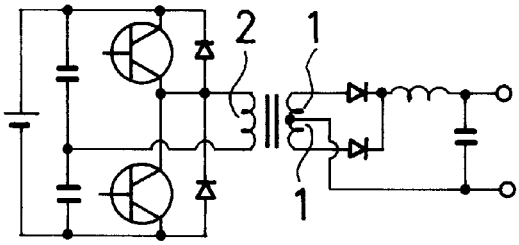
Figure 13E:
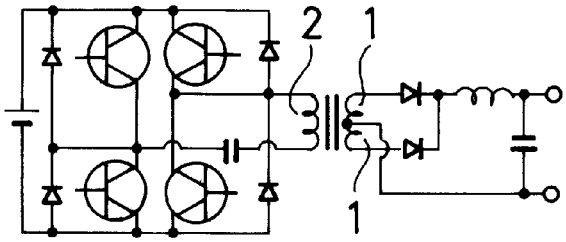

The structure having the two low-voltage side coils 1 shown in FIGS. 3, 4A and 5A may be adopted when a low-voltage side coil 1 is constituted of split coils as illustrated in FIGS. 13C through 13E is utilized. It is to be noted that if the high-voltage side coil 2 is constituted of split coils, as shown in FIG. 13C, the present invention may be adopted by mounting two high-voltage side coils 2 at a single bobbin or by utilizing two bobbins 3 each having flat-face coils provided over two layers.

Figure 14A:
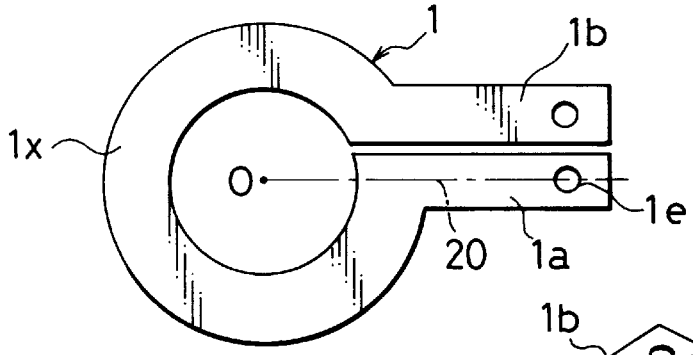
FIG. 14A is a plan view of a flat coil achieved in another embodiment of the coil apparatus according to the present invention, with FIGS. 14B, 14C and 14D respectively presenting an exploded perspective, a plan view and a sectional view of the coil apparatus.
Figure 14B:
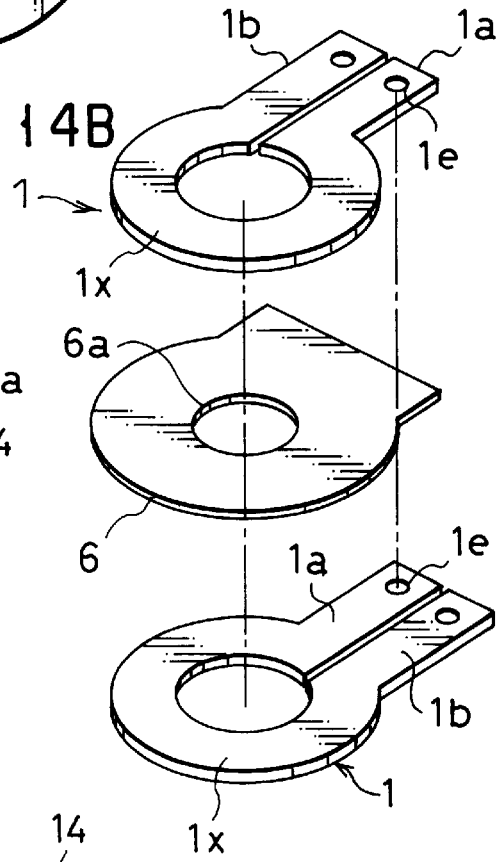
Figure 14C:
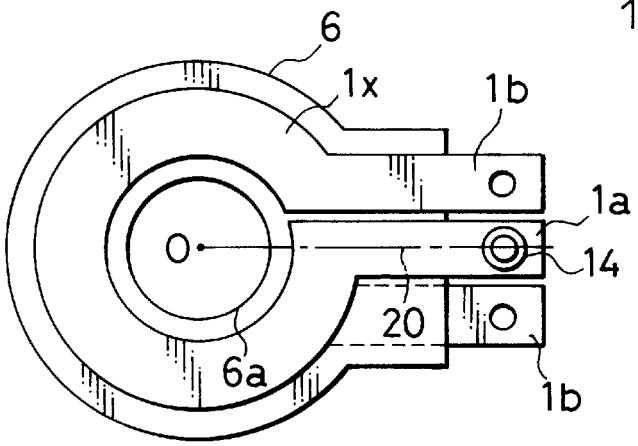
Figure 14D:
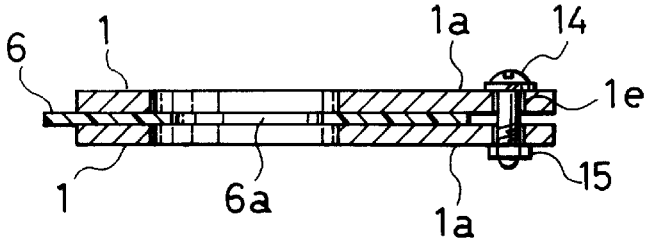

FIGS. 14A through 14D present another embodiment of the coil apparatus according to the present invention, with FIG. 14A presenting a plan view of a flat coil and FIGS. 14B, 14C and 14D respectively presenting an exploded perspective, a plan view and a sectional view of the coil apparatus. In these figures, reference numeral 1 indicates a one-turn flat coil constituted of a metal plate. A main body 1*x* of the coil 1 is formed in a toroidal shape, with a pair of coil terminals 1*a* and 1*b* which are set flush with the main body 1*x* projecting out from a portion of the external circumference of the coil 1.

One of the coil terminals, i.e., the coil terminal 1*a,* is formed by ensuring that a line 20 passing through the center of the coil terminal in along the widthwise direction passes the center O of the coil 1. The coil terminal 1*b* is formed parallel to the coil terminal 1*a*. Two identical coils structured as described above are set one on top of the other as illustrated in FIGS. 14B through 14D, by turning over one of the coils, by aligning a connecting hole 1*e* of the one coil to a connecting hole 1*e* of the other coil and also aligning the axis of the one coil 1 to the axis of the other coil 1, by placing the one coil on top of the other while insulating them from each other with an insulating sheet 6, by inserting a screw 14 at the connecting holes 1*e* and 1*e* of the coil terminals 1*a* and 1*a* on one side and then by tightening a nut 15, to connect the coil terminals 1*a* to each other thereby constituting a two-turn coil. The coil terminals 1*b* on the other side are utilized for connection with external members. The insulating sheet 6 includes a hole 6*a* at the center at which a core may be inserted.

By connecting identical coils 1 with one of the coils set in reverse orientation to constitute a coil apparatus in this manner, the number of required parts is reduced and only a small space is required for the connection. In addition, since the main bodies 1*x* of the coils 1 are formed in a toroidal shape, a core having main magnetic legs with a round sectional shape can be fitted at the centers of the coils 1 with ease.

For the coils 1 each having the staged portion id shown in FIGS. 3, 5B and 5C, too, a structure having the coil center O set on the line extending from the coil terminal 1*a* located on the side where the staged portion 1*d* is formed may be adopted.

Figure 15A:
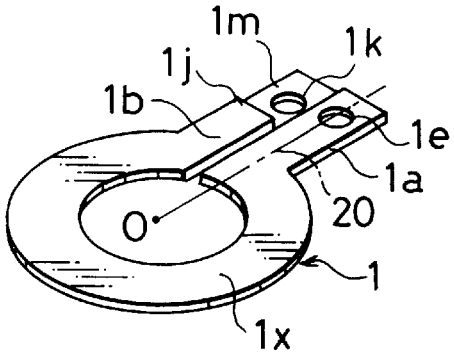
FIG. 15A is a perspective of a coil achieved in yet another embodiment of the coil apparatus according to the present invention.
Figure 15B:
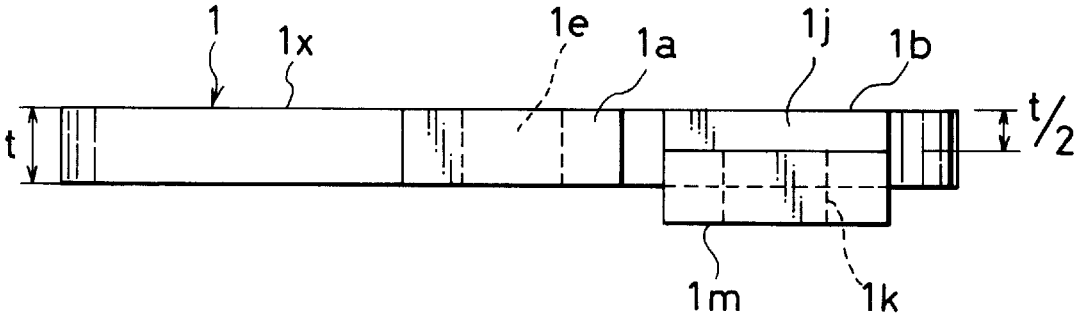
FIG. 15B is a side elevation thereof and FIG. 15C shows two such coils placed one on top of the other.
Figure 15C:
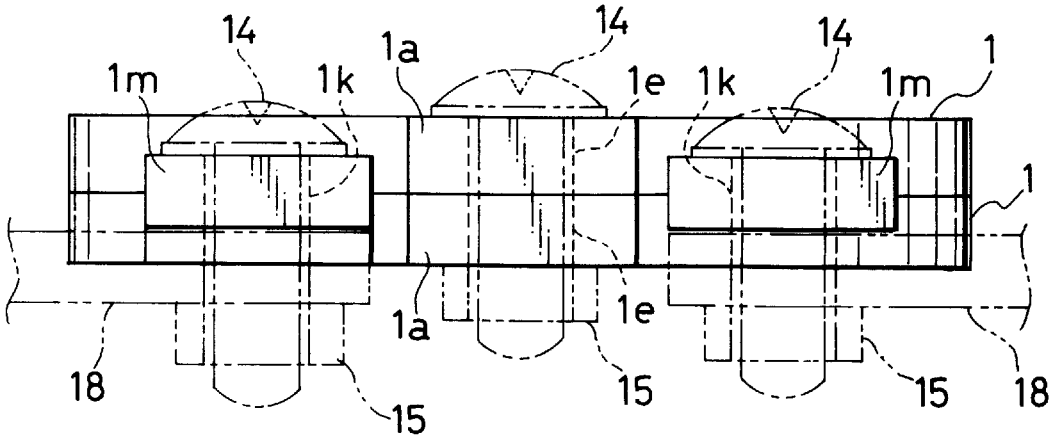

FIGS. 15A through 15C present another embodiment of the coil apparatus according to the present invention. FIG. 15A is a perspective of the coil, FIG. 15B is a view taken from the coil terminal side and FIG. 15C shows two such coils placed one on top of the other. In this embodiment, a staged portion 1*j* is formed over a depth of t/2 which is half the thickness t of the coil 1, at a position in the middle of the other coil terminal 1*b* of the coil, i.e., in the middle of the coil terminal formed parallel to the coil terminal 1*a* projecting out on an extended line along the direction of the radius of the coil 1, as shown in FIGS. 15A and 15B. In addition a connecting portion 1*m* that includes a connecting hole 1*k* for connection with another member is provided at a flat surface at the front end which is not the coil main body.

Then, by reversing one of the two coils and coupling the two coils at the coil terminals 1*a* with the screw 14, the nut 15 and the like as shown in FIG. 15C, the coil terminals 1*b* and 1*b* on the other side are set flush with each other.

By combining the two coils 1 with their coil terminals 1*b* and 1*b* on the other side set flush with each other in this manner, the positions of the two coil terminals can be adjusted to the height of a connecting member 18 of another member to which the coil apparatus is connected as when the coil apparatus is mounted on, for instance, a substrate, to eliminate the need for spacers with varying heights. It is to be noted that by treating all the surfaces of the coils 1 at which they are set one up on top of the other for insulation or by setting the coils 1 one on top of the other via an insulating member provided in between, a two-turn coil is achieved.

Figure 16A:
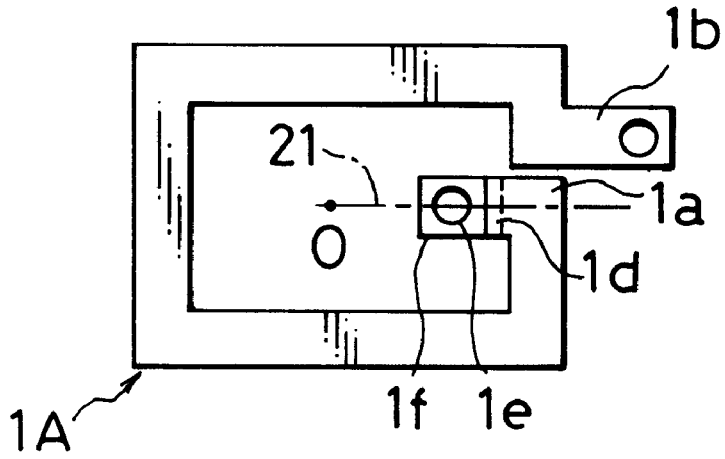
FIG. 16A is a plan view of a coil achieved in yet another embodiment of the coil apparatus according to the present invention and FIG. 16B presents its perspective.
Figure 16B:
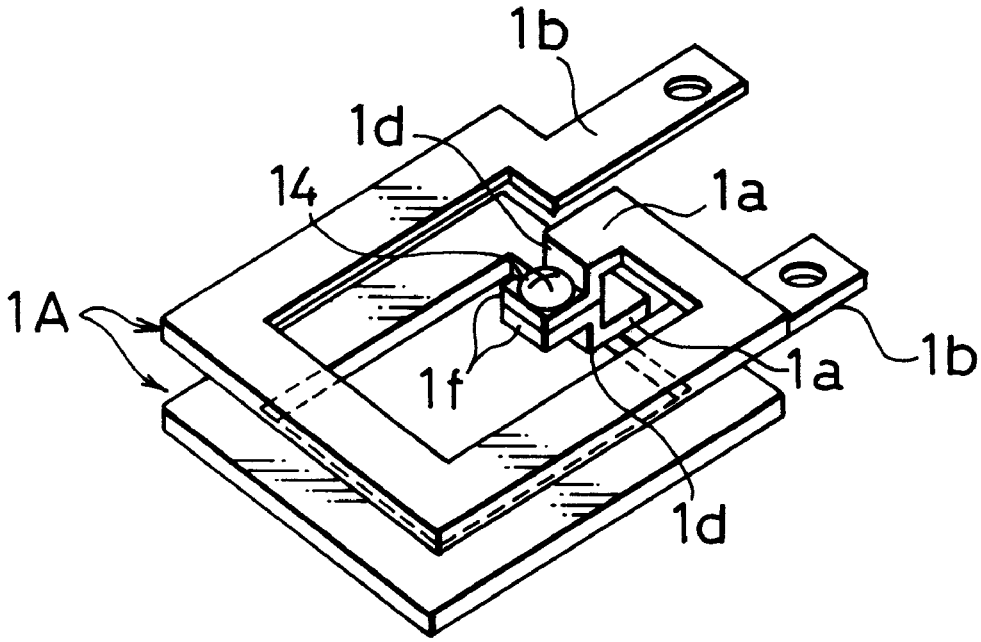

FIGS. 16A and 16B show yet another embodiment of the coil apparatus according to the present invention. FIG. 16A is a plan view of the coil and FIG. 16B is a perspective of the coil. The coil 1A has a main body formed in a toroidal shape with angular corners. One coil terminal 1*a* is formed by ensuring that a line 21 passing through the center of the coil terminal 1*a* along the widthwise direction also passes the center of the coil 1A. In addition, a connecting portion if at the front end of the coil terminal 1*a* includes a staged portion 1*d* in the middle to set it on a plane different from the plane on which the coil main body is set. The other coil terminal 1*b* is formed parallel to the coil terminal 1*a*.

By forming the coil in a toroidal shape with angular corners, a core with a magnetic leg having a polygonal sectional shape can be set at the center of the coil with ease. It is to be noted that while the coil terminal 1*a* is formed to turn inward to allow a greater space margin to accommodate the lead out portion in the example presented in FIGS. 16A and 16B, the coil terminal 1*a* may be formed to turn outward, instead.

What is claimed is:

1. A coil apparatus comprising;

a coil that includes at least a one-turn coil constituted of a metal plate, with a pair of coil terminals provided at one end and a retaining piece projecting out at another end of an external circumference thereof formed in a toroidal shape;

an insulating case that includes a plate member having a magnetic leg insertion hole at which a main magnetic leg of a core is inserted, with;

a fitting wall at which said coil is fitted provided around a coil mounting surface of said plate member;

notched portions formed on a coil terminal mounting side where said coil is mounted at said fitting wall and also on a side opposite from said coil terminal mounting side of said insulating case, and a first retaining portion and a second retaining portion for retaining said coil provided at extended portions extending along the radial direction at said notched portions; and said coil fitted at said fitting wall and said coil terminals and said retaining piece of said coil respectively retained at said first retaining portion and said second retaining portion to prevent said coil from becoming lifted from said insulating case; and said core constituted of split cores each having main magnetic legs, a side magnetic leg and a bridging portion bridging between said main magnetic legs and said side magnetic leg, with said main magnetic legs of said core inserted at said coil, said side magnetic leg set on the external circumferential side of said insulating case and one of said bridging portions set to face opposite said coil over a distance.

2. A coil apparatus according to claim 1, wherein;

said retaining piece of said coil is retained at said second retaining portion of said insulating case while allowing a retaining margin which allows said retaining piece to move along the rotational direction relative to said second retaining portion; and said retaining portion that retains said coil terminals retains said coil terminals on the other side as said coil is rotated.

3. A coil apparatus according to claim 1, further comprising;

a bobbin; and another coil wound around said bobbin, wherein;

said bobbin includes a cylindrical winding drum and flanges formed at two ends of said winding drum;

said insulating case includes a side wall projecting on a side opposite from said fitting wall, from an outer side of said plate member; and said bobbin having said other coil wound around is housed inside said side wall and a coil terminal of said other coil is led out to the outside through a notched portion provided at said side wall of said insulating case.

4. A coil apparatus according to claim 3, constituting a power transformer with said other coil utilized as a high-voltage side coil and said one-turn coil utilized as a low-voltage side coil, wherein;

said high-voltage side coil is achieved by setting flat-face coils, which are wound spirally around said winding drum, one on top of the other over two layers along the axial direction continuously on the internal circumferential side.

5. A coil apparatus according to claim 4, wherein;

said winding drum is provided with a winding isolation piece projecting further outward relative to the external circumference of a cylindrical portion thereof; and said flat-face coils are set one on top of the other via said winding isolation piece.

6. A coil apparatus according to claim 3, constituting a power transformer with said other coil utilized as a high-voltage side coil and said one-turn coil utilized as a low-voltage side coil, wherein;

said low-voltage side coil is provided on the outside of each of the two ends of said insulating case.

7. A coil apparatus according to claim 3, constituting a power transformer with said other coil utilized as a high voltage side coil and said one-turn coil utilized as a low-voltage side coil, wherein;

said insulating case includes a first case and a second case;

said first case and said second case are each provided with a plate member having a magnetic leg insertion hole at which a core main magnetic leg is inserted and a side wall extending almost perpendicular from an outer side of said plate member;

said side walls of said first case and said second case overlap each other along the direction of the radius of said coil and each includes a notched portion for winding lead out;

said insulating case is placed over said bobbin having wound thereon said high-voltage side coil and a terminal of said high-voltage side coil is led out through said notched portion;

said U-shaped low-voltage side coil is set on the outside of said plate member of at least either said first case or said second case constituting said insulating case and;

said main magnetic legs of said core are inserted at said winding drum, said low-voltage side coil and said magnetic leg insertion hole of said insulating case and said side magnetic legs of said core are set on the outside of said side walls of said insulating case.

8. A coil apparatus comprising a bobbin, an insulating case, a high-voltage side coil, a low-voltage side coil and a core to constitute a power transformer, wherein;

said bobbin includes a cylindrical winding drum and flanges formed at two ends of said winding drum;

said high-voltage coil is wound around said winding drum;

said high-voltage side coil is housed together with said bobbin inside said insulating case;

said insulating case includes a first case and a second case;

said first case and said second case are each provided with a plate member having a magnetic leg insertion hole at which a core main magnetic leg is inserted and a side wall extending almost perpendicular from an outer side of said plate member;

said side walls of said first case and said second case overlap each other along the direction of the radius of said coils and each include a notched portion for winding lead out;

said insulating case is placed over said bobbin having wound thereon said high-voltage side coil and a terminal of said high-voltage side coil is led out through said notched portion;

said low-voltage side coil is constituted of a metal plate formed in a to roughly U-shape and is set on the outside of said plate member of at least either said first case or said second case;

said core is constituted of split cores each having main magnetic legs, a side magnetic leg and a bridging portion bridging between said main magnetic legs and said side magnetic leg; and said main magnetic legs of said core are inserted at said winding drum, said low-voltage side coil and said magnetic legs insertion holes of said insulating case and said side magnetic legs of said core are set on the outside of said side walls of said insulating case.

9. A coil apparatus according to claim 8, wherein;

said low-voltage side coil is provided on the outside of said plate member of each of said first case and said second case.

* * * * *